US007952530B1

(12) United States Patent
Gerhard

(10) Patent No.: US 7,952,530 B1
(45) Date of Patent: May 31, 2011

(54) SERPENTINE BUOYANT CABLE ANTENNA

(75) Inventor: Erich M. Gerhard, South Kingstown, RI (US); Heidi R. Pickreign, legal representative, Harvard, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 758 days.

(21) Appl. No.: 11/650,764

(22) Filed: Dec. 26, 2006

(51) Int. Cl.
*H01Q 1/04* (2006.01)

(52) U.S. Cl. ..... 343/719

(58) Field of Classification Search ..... 343/709, 343/719, 888, 877–878, 880–881
See application file for complete search history.

(56) References Cited

U.S. PATENT DOCUMENTS 2,570,707 A 10/1951 Parr, Jr.
2,638,176 A 5/1953 Doolittle
3,287,691 A 11/1966 Savit
5,272,486 A * 12/1993 Dickinson ..... 343/719
5,933,117 A * 8/1999 Gerhard ..... 343/709
6,897,822 B2 * 5/2005 Sparks et al. ..... 343/767
7,411,558 B1 * 8/2008 Pickreign et al. ..... 343/709
7,466,278 B1 * 12/2008 Pickreign et al. ..... 343/709
7,468,703 B1 * 12/2008 Pickreign et al. ..... 343/709

* cited by examiner

*Primary Examiner* — Huedung Mancuso
(74) *Attorney, Agent, or Firm* — James M. Kasischke; Jean-Paul A. Nasser; Michael P. Stanley

(57) ABSTRACT

The present invention relates to an improved buoyant cable antenna system. The system includes a buoyant cable transmission line segment and an antenna segment formed from a flexible memory structure comprised of at least one segment of coiled compression, pinched to form a desired shape and encapsulated in a buoyant encapsulant material. The antenna segment may include a U-shaped keel portion, a horizontal serpentine shaped section, and a vertical element with the horizontal serpentine shaped section floating on the surface of the water and the vertical element extending above the surface of the water. A process for manufacturing the buoyant cable antenna system is also described.

12 Claims, 3 Drawing Sheets

SERPENTINE BUOYANT CABLE ANTENNA

STATEMENT OF GOVERNMENT INTEREST

The invention described herein may be manufactured and used by or for the Government of the United States of America for governmental purposes without the payment of any royalties thereon or therefor.

CROSS REFERENCE TO RELATED PATENT APPLICATION

The instant application is related to three co-pending U.S. Patent Applications entitled BUOYANT CABLE ANTENNA SYSTEM AND METHOD WITH ARTIULATING BLOCKS (Navy Case No. 80224), BUOYANT CABLE ANTENNA CONFIGURATION AND SYSTEM (Navy Case No. 80225), BUOYANT CABLE ANTENNA SYSTEM (Navy Case No. 8.0227) having the same filing date.

BACKGROUND OF THE INVENTION (1) Field of the Invention

The present invention relates to an improved buoyant cable antenna for marine applications and a process of manufacturing same.

(2) Description of the Prior Art

Buoyant cable arrangements have been used in a number of marine applications. For example, buoyant cables have been used in the seismic surveying of underwater geological formations. U.S. Pat. Nos. 2,570,707 to Parr and 2,638,176 to Doolittle illustrate two such buoyant cable arrangements. In the Parr system, the cable is constructed and arranged to float one the water surface, either by virtue of its own buoyancy or by the use of buoyant devices secured thereto. The cable, in a preferred embodiment, was a metal cable, such as a stainless steel cable, to which were secured cork floats. In Doolittle, the cable is supported by a plurality of floats.

U.S. Pat. No. 3,287,691 to Savit illustrates a deployed hydrophone cable. The cable comprises a plurality of hydrophones connected to the cable in spaced relationship along its length and floatable cable covering segments having a positive buoyancy encasing the cable between the hydrophones. The hydrophone cable itself comprises a conventional multiconductor insulated cable.

Buoyant cable antenna systems are known in the prior art. FIG. 1 illustrates one such buoyant cable antenna system 10 which is deployed from a submerged vehicle 12. The system 10 includes a buoyant cable transmission line 14, to which is connected in sequence a loop amplifier 16, an athwart loop antenna 18, a wire amplifier 20, and a horizontal antenna element 22.

On-going buoyant cable antenna research requires the use of a flexible buoyant material, that when deployed by a marine vehicle, such as a submerged vehicle, realizes a designed shape.

SUMMARY OF THE INVENTION

Accordingly, it is an object of the present invention to provide an improved buoyant cable antenna system.

It is a further object of the present invention to provide a buoyant cable antenna system as above utilizing a serpentine shape and a keel portion.

It is yet a further object of the present invention to provide a process for manufacturing a buoyant cable antenna system.

The foregoing objects are attained by the buoyant cable antenna system of the present invention.

In accordance with the present invention, a buoyant cable antenna system is provided. The buoyant cable antenna system broadly comprises a buoyant cable transmission line segment and an antenna segment formed from a flexible memory structure of coil compression spring encapsulated in a buoyant molding material attached to an end of the buoyant cable transmission line segment. The flexible memory material forming the antenna segment is capable of assuming a designed shape and recover after being straightened and flexed.

The buoyant cable antenna system may be manufactured using a process comprising the steps of creating an antenna segment by providing at least one compression spring having a plurality of coils, pinching the coils of the at least one compression spring to impart a desired shape to the at least one compression spring, and encapsulating the at least one compression spring within a buoyant flexible encapsulation material. The process further comprises joining the antenna segment to a buoyant cable transmission line segment.

Other details of the buoyant cable antenna system of the present invention and the process for manufacturing same, as well as other objects and advantages attendant thereto, are set forth in the following detailed description and the accompanying drawings wherein like reference numerals depict like elements.

DESCRIPTION OF THE PREFERRED EMBODIMENT

Figure 1:
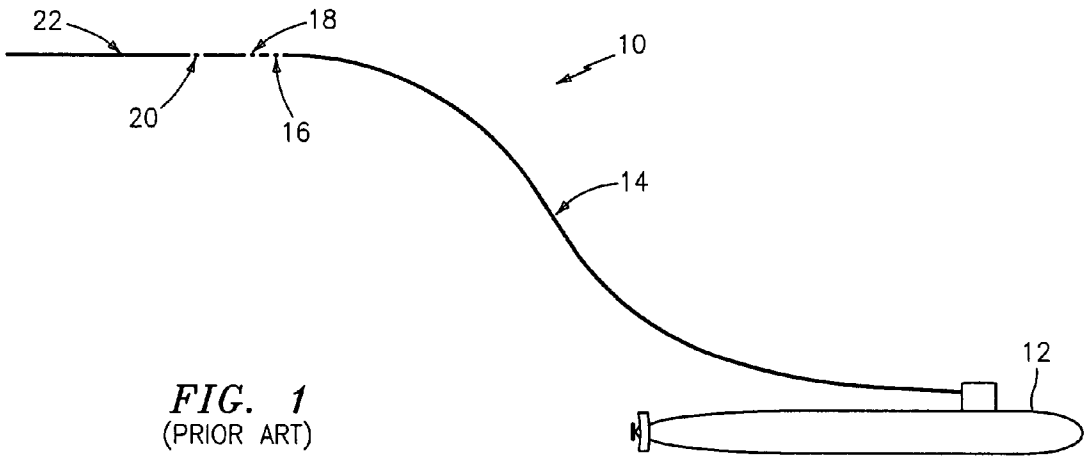
FIG. 1 (PRIOR ART)
FIG. 1 is a schematic representation of an existing buoyant cable antenna system.
Figure 2:
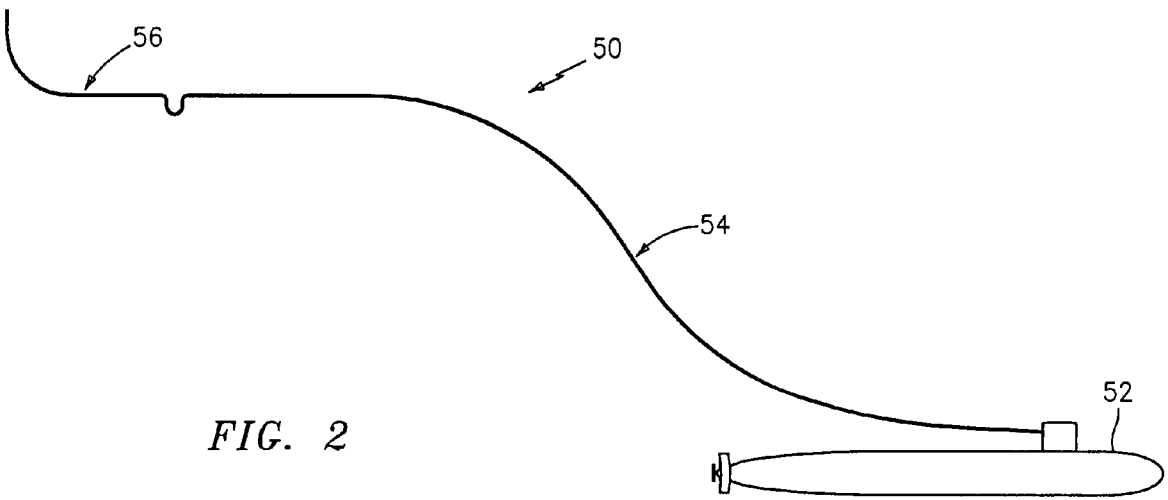
FIG. 2 is a side view of the system of FIG. 4.
Figure 3:
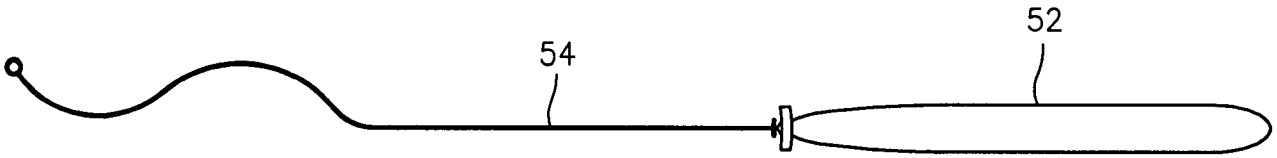
FIG. 3 (PRIOR ART)
FIG. 3 is a top view of the antenna system of FIG. 2.
Figure 4:
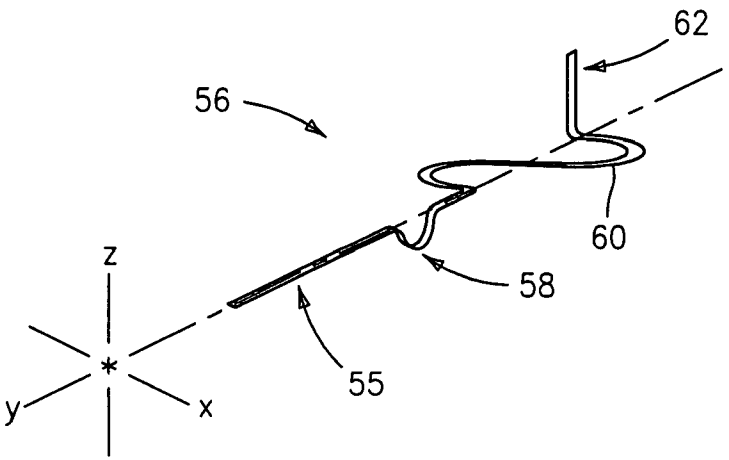
FIG. 4 is a perspective view of an antenna segment used in the buoyant cable antenna system of FIG. 2 in accordance with the present invention.
Figure 5:
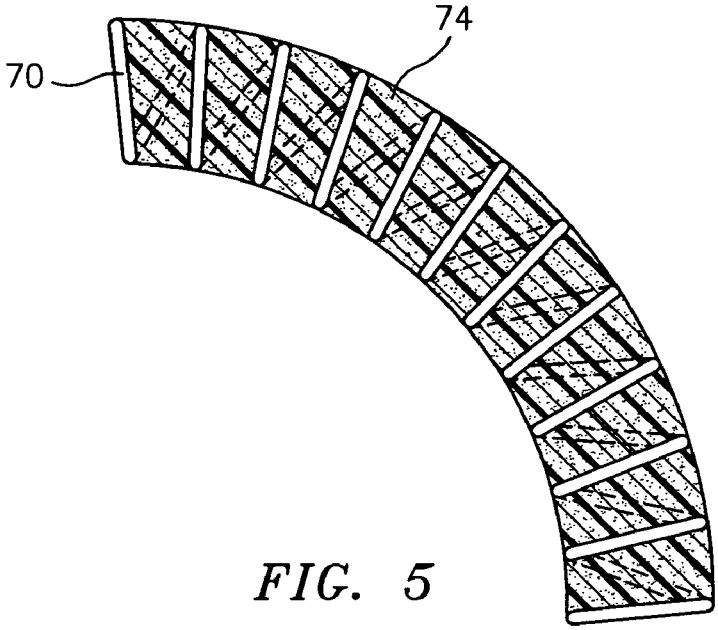
FIG. 5 is a side view of a coil spring encapsulated in cured spongy plastic.
Figure 6:
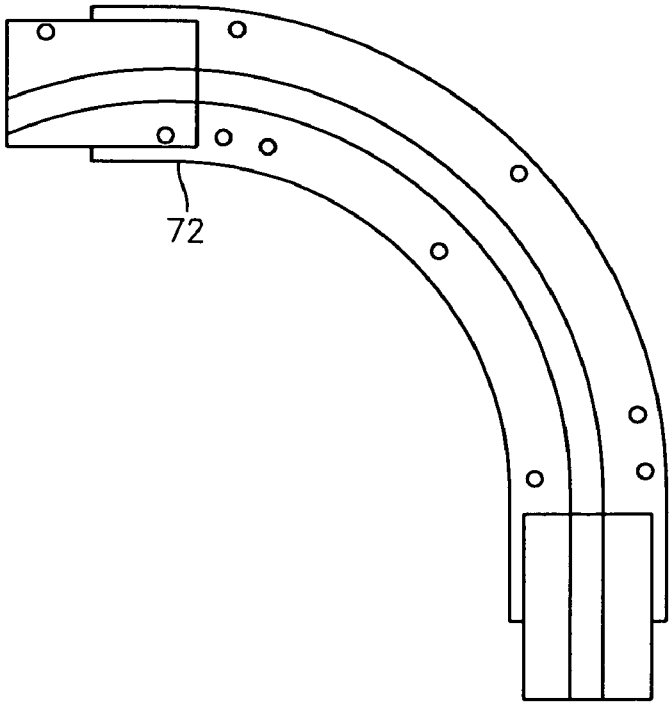
FIG. 6 is a sectional view of a mold for forming the antenna segment of the buoyant cable antenna system.

Referring now to FIGS. 2-4, a buoyant cable antenna system 50 in accordance with the present invention may be deployed from a submerged marine vehicle 52. The buoyant cable antenna system 50 includes a buoyant cable transmission line segment 54 and an antenna segment 56 attached to an end of the buoyant cable transmission line segment 54 by a joint 55. The buoyant cable transmission line segment 54 may comprise any suitable buoyant cable transmission line known in the art.

The antenna segment 56 may have a variety of sections having different shapes, preferably all formed from a flexible memory material. For example, the antenna segment 56 may include a U-shaped keel portion 58 to counterbalance vertical element 62. Following the keel portion 58, the antenna segment 56 may include a horizontal serpentine shaped section 60. The section 60, in a preferred embodiment, floats on the water surface. Still further, the antenna segment 56 may include a vertical element 62. Element 62 is a fractional wavelength rigid linear conductor 63 suitably moisture proofed by a casing. A conventional microwave coaxial transmission line (not shown) extends through the one or more helical springs and the linear conductor element is suitably connected by a coupling arrangement (not shown) with the transmission line.

In a preferred embodiment of the present invention, the joint 55, the keel portion 58, the horizontal serpentine shaped section 60, and the curved portion of vertical antenna element 62 are each formed from an encapsulated compression helical spring coil structure. Any suitable technique known in the art may be used to form the portion 58, the section 60, and the vertical element 62 from a suitable flexible memory material. The serpentine section 60, which includes buoyant encapsulant, imparts forces maintaining section 62 vertical.

In a preferred technique, each of the aforementioned antenna sections (except segment 62 which is rigid linear antenna elements) is formed from one or more compression springs 70. When a coil of a compression spring 70 is pinched into a curved shape with a consecutive coil in a given area, the compression spring 70 will start to assume a curved shape. By pinching a plurality of coils along the length of the compression spring 70, the compression spring 70 will assume a particular curved shape. Thus, a compression spring 70 can be pinched to form the shape of the U-shaped keel portion 58. If desired, a separate compression spring or the same compression spring could be pinched to form the horizontal serpentine shaped portion 60. Further, the coupling at the lower end of vertical element 62 can be formed from the same compression spring or yet another compression spring permitting bending for storage in linear relation thereto. Once the compression spring or springs 70 have been shaped, it is or they are laid in a mold 72. The mold 72 is then filled with an encapsulating material 74 that encapsulates the spring(s) 70 and retains the desired spring shape. One suitable material which provides buoyancy is the microballoon loaded polymer disclosed in U.S. Pat. No. 5,606,329 entitled "Buoyant Cable Antenna", hereby incorporated by reference in its entirety. The result is a flexible construction which has a shape memory so that it returns to the encapsulated shape even after being straightened and/or flexed. The encapsulating material 74, in addition to insuring that the desired shape will be retained, provides increased mechanical rigidity to the encapsulated spring 70. Springs of any spring constant can be used to provide an end desired material spring constant. After the antenna segment 56 is formed, it may be joined in any suitable manner to the buoyant cable transmission line 54 using any suitable means known in the art such as joint 55.

By providing an antenna segment 56 having a vertical element 62 which extends above the water surface, one can extend the frequency range of the antenna.

While the antenna system of the present invention has been illustrated as being deployed from a submerged vehicle 52, such a submarine, it may be deployed from any suitable marine vehicle.

It is apparent that there has been provided in accordance with the present invention a serpentine buoyant cable antenna which fully satisfies the objects, means and advantages set forth hereinbefore. While the present invention has been described in the context of specific embodiments thereof, other alternatives, modifications, and variations will become apparent to those skilled in the art having read the foregoing description. Therefore, it is intended to embrace those alternatives, modifications, and variations which fall within the broad scope of the appended claims.

What is claimed is:

1. A buoyant cable antenna system comprising:

a buoyant cable transmission line segment; and an antenna segment joined to said transmission line segment, wherein said antenna segment is formed from a flexible memory structure comprised of at least one coiled compression spring encapsulated in a buoyancy producing encapsulation medium.

2. A buoyant cable antenna system according to claim 1, wherein said antenna segment includes a keel portion.

3. A buoyant cable antenna system according to claim 2, wherein said keel portion is U-shaped.

4. A buoyant cable antenna system according to claim 1, wherein said antenna segment includes a horizontal serpentine portion.

5. A buoyant cable antenna system according to claim 4, wherein said horizontal serpentine portion floats on a water surface.

6. A buoyant cable antenna system according to claim 5, wherein said horizontal serpentine portion floats on an ocean surface.

7. A buoyant cable antenna system according to claim 1, wherein said antenna segment includes a vertically oriented rigid conductor element.

8. A buoyant cable antenna system according to claim 1, wherein said antenna segment includes a U-shaped keel portion, a vertical element, and a horizontal serpentine shape portion extending between said keel portion and said vertical element.

9. A process for manufacturing a buoyant cable antenna system comprising:

creating an antenna segment by providing at least one compression spring having a plurality of coils;

pinching the coils of said at least one compression spring into a curved shape to impart a desired shape to said at least one compression spring; and encapsulating said at least one compression spring within a flexible encapsulation material to thereby impart mechanical rigidity to compression springs in said desired shape.

10. A process according to claim 9, further comprising creating said antenna segment to have a substantially U-shaped keel portion.

11. A process according to claim 9, further comprising creating said antenna segment to have a horizontal serpentine shaped portion.

12. A process according to claim 9, further comprising creating said antenna segment to have a vertical antenna element.

* * * * *